US008885000B2

(12) United States Patent
Sasaki

(10) Patent No.: US 8,885,000 B2
(45) Date of Patent: Nov. 11, 2014

(54) DISPLAY PANEL DRIVING METHOD, DISPLAY DEVICE DRIVING CIRCUIT, AND DISPLAY DEVICE

(75) Inventor: Takashi Sasaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 167 days.

(21) Appl. No.: 13/581,042

(22) PCT Filed: Feb. 3, 2011

(86) PCT No.: PCT/JP2011/052213

§ 371 (c)(1),
(2), (4) Date: Aug. 24, 2012

(87) PCT Pub. No.: WO2011/114791

PCT Pub. Date: Sep. 22, 2011

(65) Prior Publication Data

US 2012/0313983 A1 Dec. 13, 2012

(30) Foreign Application Priority Data

Mar. 19, 2010 (JP) ..... 2010-064244

(51) Int. Cl.

*G09G 5/10* (2006.01)
*G09G 3/20* (2006.01)
*G09G 3/36* (2006.01)

(52) U.S. Cl.

CPC ..... *G09G 3/2092* (2013.01); *G09G 2320/0271* (2013.01); *G09G 2320/0686* (2013.01); *G09G 3/3648* (2013.01); *G09G 2310/0232* (2013.01); *G09G 2320/0233* (2013.01)

USPC ..... 345/694; 345/204; 345/214

(58) Field of Classification Search

CPC ..... G09G 5/10; G09G 5/11; G09G 3/3607

USPC ..... 345/204, 690, 214

See application file for complete search history.

(56) References Cited

U.S. PATENT DOCUMENTS

2005/0093798 A1* 5/2005 Kamada et al. ..... 345/89
2011/0025730 A1* 2/2011 Ajichi ..... 345/690

FOREIGN PATENT DOCUMENTS

JP 2005-134560 A 5/2005
JP 2007-88980 A 4/2007
JP 2008-42843 A 2/2008
JP 2009-237088 A 10/2009
JP 2010-15918 A 1/2010

OTHER PUBLICATIONS

An International Search Report, dated Apr. 26, 2011, in International Application No. PCT/JP2011/052213.

* cited by examiner

*Primary Examiner* — Andrew Sasinowski
(74) *Attorney, Agent, or Firm* — Lowe Hauptman & Ham, LLP

(57) ABSTRACT

The present invention relates to a method of driving a liquid crystal panel 40 including a first display area 42 and a second display area 44. The first display area 42 includes a middle portion of the display panel and the second display area 44 includes an outer portion around the first display area 42. The method including the following steps: (1) supplying image data to the display areas through a supply circuit 12 to display the image therein; and (2) correcting only the image data for the second display area 44 in a first correction circuit 20 when the supply circuit 12 supplies the image data. In this driving method, the image data for the second display area 44 is corrected, but the image data for the first display area 42 is not corrected. As a result, the deterioration of brightness and gradation characteristics can be suppressed while the unevenness in the liquid crystal panel 40 is reduced.

14 Claims, 9 Drawing Sheets

DISPLAY PANEL DRIVING METHOD, DISPLAY DEVICE DRIVING CIRCUIT, AND DISPLAY DEVICE

RELATED APPLICATIONS

The present application is based on International Application No. PCT/JP2011/052213, filed Feb. 3, 2011 and claims priority from, Japanese Application No. 2010-064244, filed Mar. 19, 2010.

TECHNICAL FIELD

The present invention relates to a method of driving a display panel, a display device driving circuit, and a display device, in particular to a technology that drives a display panel by supplying an image data to each of display areas of the display panel included in the display device.

BACKGROUND ART

In recent years, high-performance display devices such as a large screen television have become widely used. An image quality of the display devices is highly affected by uneven brightness and uneven color in a displayed image (hereinafter, the uneven brightness and the uneven color may be collectively referred to as "unevenness"), and thus correction of unevenness is required.

Patent Document 1 discloses a technology for correcting unevenness. According to the technology, a display panel on which an evaluation image is displayed is captured with a camera to obtain a photographic data, and then a brightness distribution and/or a color distribution of the display panel is/are extracted from the photographic data. Then, the extracted brightness distribution and/or the extracted color distribution is/are corrected based on an ideal brightness distribution and/or an ideal color distribution. In the brightness distribution and/or the color distribution, the ideal brightness distribution and/or the ideal color distribution include(s) "non-uniform distribution of display light intensity" that is barely-noticeable to the human eye. According to the technology disclosed in Patent Document 1, the brightness distribution and/or the color distribution is/are corrected based on the ideal brightness distribution and/or the ideal color distribution. This reduces deterioration of brightness and gradation characteristics of the entire display area compared with the case that the brightness distribution and/or the color distribution of the display panel is/are corrected to be uniform.

RELATED ART DOCUMENT

Patent Document

Patent Document 1: Japanese Unexamined Patent Publication No. 2007-88980

Problem to be Solved by the Invention

The technology disclosed in Patent Document 1 cannot suppress the deterioration of brightness and gradation characteristics that may occur in a middle portion of a display area. A display device may have illumination unevenness due to the arrangement of backlights. In such a case, the unevenness may only occur in an outer periphery of the display area and may not occur in the middle portion of the display area, and thus the middle portion of the display area does not require the correction. However, according to the technology disclosed in Patent Document 1, the ideal brightness distribution and/or the ideal color distribution is/are determined for the entire area of the display area. Thus, the middle portion of the display area is always corrected. As a result, the deterioration of brightness and gradation characteristic due to such a correction may occur in the middle portion of the display area.

DISCLOSURE OF THE PRESENT INVENTION

The present invention was accomplished in view of the above circumstances. It is an object of the present invention to provide a technology that can advantageously reduce the unevenness and suppress the deterioration of brightness and gradation characteristics at the same time.

Means for Solving the Problem

To solve the above problem, the present invention provides a method of driving a display panel having a display area including a first display area and a second display area. The first display area includes a middle portion of the display panel and the second display area includes an outer portion of the display panel around the first display area. The method includes supplying image data to each of the first display area and the second display area to display an image therein, and performing a first correction to correct only the image data for the second display area while the image data supplying step is being performed.

In this method of driving a display panel, when the image data is supplied to each of the display areas to display the image on the display area, the image data for the second display area is corrected, but the image data for the first display area is not corrected. By correcting the image data for the second display area, the unevenness occurred in the second display area can be reduced. Further, by not correcting the image data for the first display area, the deterioration of brightness and gradation characteristics that may occur in the first display area can be suppressed. The first display area includes the middle portion of the display panel that is the most easily viewable by a user. Accordingly, the quality of the display panel can be maintained at a high level by reducing the deterioration of brightness and gradation characteristics in the first display area. Further, the first display area is often used for characteristics measurement of the display panel. The characteristics of the display panel can be maintained at a high level by reducing the deterioration of brightness and gradation characteristics in the first display area.

As described above, the method of driving a display panel according to the present invention can advantageously suppress the deterioration of brightness and gradation characteristics in the middle portion and reduce unevenness in an outer portion around the middle portion at the same time.

Preferably, the second display area includes at least one outer periphery or opposing two outer peripheries of the display area of the display panel. The "outer periphery" of the display area is a part of the display area that separates the display area of the display panel from a non-display area extending outwardly from the display area. For example, a display area having a rectangular shape includes four outer peripheries.

The unevenness in the second display area is more likely to occur in the outer periphery of the display panel. An example of this is illumination unevenness caused by the backlight that is used in combination with the display panel. According to the present invention, the second display area includes one outer periphery or opposing two outer peripheries of the display panel. This reduces the unevenness that may occur in the outer periphery of the display panel.

In the first correction according to the present invention, preferably, the first correction includes correcting the image data for the second display area based on first correction data determined for each of reference gradation levels. The gradation levels are selected from displayable gradation levels.

Generally, the correction required for the image data vary according to the gradation level. According to the present invention, the first image data is determined for each of the reference gradation levels. Accordingly, suitable correction for each gradation level can be performed.

If uncorrected brightness value of the image data in the first display area and uncorrected brightness value of the image data in the second display area are consecutively present at a boundary between the first display area and the second display area, the first correction data is determined such that the uncorrected brightness value of the image data in the first display area and a corrected brightness value of the image data in the second display area are consecutively present. The corrected brightness value is defined by correcting the uncorrected brightness value in the second display area based on the first correction data.

According to the present invention, the image data for the second display area is corrected, but the image data for the first display area is not corrected. Thus, at a boundary between the first display area and the second display area, even if the uncorrected brightness value of the image data in the first display area and the uncorrected brightness value of the image data in the second display area are consecutively present, the uncorrected brightness value of the image data in the first display area and the corrected image data in the second display area are not consecutively present. Accordingly, the boundary may be visible on the display panel as "difference" in the brightness values of the image data. According to the present invention, the first correction data is determined such that the uncorrected brightness value of the image data in the first display area and the corrected brightness value of the image data in the second display area are consecutive at the boundary. As a result, the boundary between the first display area and the second display area is less likely to be visible on the display panel.

If the uncorrected brightness value of the image data in the second display area is consecutive, preferably, the first correction data is determined such that the corrected brightness value of the image data in the second display area becomes smaller toward the outer periphery of the display panel from the middle portion. The corrected brightness value is defined by correcting the uncorrected brightness value in the second display area based on the first correction data. With such a configuration, the correction required in the first correction can be less than the case that the brightness value is corrected to be constant. As a result, the deterioration of brightness and gradation characteristics in the second display area can be suppressed. If the corrected brightness value of the image data in the second display area become smaller based on the "ideal brightness distribution" disclosed in the conventional art, the user can view the display panel with less uncomfortable feeling.

A second correction may be further performed. The second correction corrects the image data for the display area including the first display area and the second display area. Preferably, the second correction is performed after the first correction. When the display panel is used in combination with the backlight, unevenness such as illumination unevenness may be caused by the backlight in the second display area. In such a case, the unevenness in the second display area is corrected in the first correction, and then the second correction is performed on the area including the first display area and the second display area. This can reduce the correction required for the first display area compared with the case that the area including the first display area and the second display area is corrected in one correction. Thus, the deterioration of brightness and gradation characteristics of the first display area is less likely to occur.

Preferably, the display panel is a liquid crystal panel using liquid crystals. This can reduce the unevenness in the liquid crystal panel used in a large screen television and suppress the deterioration of brightness and gradation characteristics.

The present invention may be embodied as a driving circuit that performs the above-described method of driving a display panel. The driving circuit for a display panel according to the present invention is a driving circuit for the display panel having a display area including the first display area and the second display area. The driving circuit includes a supply circuit configured to supply an image data to each of the first display area and the second display area to display the image therein. The first display area includes the middle portion of the display panel and the second display area includes an outer portion of the display panel around the first display area. The supply circuit includes a first correction circuit configured to correct only the image data for the second display image area. In such a driving circuit, the above-described driving method can be performed, and thus the unevenness in the display panel can be reduced and the deterioration of brightness and gradation characteristics can be suppressed.

The present invention may be embodied as a display device including a display panel to be driven by the above driving method. The display panel has a display area including a first display area and a second display area. The first display area includes a middle portion of the display panel and the second display area includes an outer portion of the display panel around the first display area. The display device includes a supply circuit configured to supply image data to each of the first display area and the second display area to display the image therein. The supply circuit includes a first correction circuit configured to correct the image data for the second display area. In such a display device, the above-described driving method can be performed. Accordingly, the unevenness in the display panel can be properly reduced and the deterioration of brightness and gradation characteristics can be suppressed.

The display device may include the display panel and the backlight unit. The backlight unit may include a light source and alight guide plate. The light guide plate may have a light entrance surface facing the light source and a light exit surface facing the display panel. The light guide plate is configured to guide the light entering the light entrance surface from the light source to the light exit surface. Preferably, the light entrance surface is aside surface of the light guide plate and the light exit surface is a main surface of the light guide plate.

In the display device including an edge-light type backlight unit, the second display area is closer to the light source, and thus, the illumination unevenness in the display panel is more likely to occur in the second display area than the first display area. More specifically, in the edge-light type backlight unit, the light sources are arranged on a side surface side of the light guide plate. The light enters through the side surface and exits from the main surface of the light guide body. According to the present invention, the display device includes the first correction circuit that only corrects the image data for the second display area. Thus, even if the unevenness occurs in the second display area, the unevenness can be properly reduced.

The display device may include the display panel and the backlight unit. The backlight unit may include a light source and a diffuser plate. The light source faces the display panel. The diffuser plate is arranged between the light source and the display panel.

In a direct-type backlight unit in which a light enters from a rear surface of the diffuser plate and exits from a front surface thereof, light sources are regularly arranged on the rear surface of the diffuser plate over the area corresponding to the display area. The light cannot reach an area surrounding the regularly arranged light sources, and thus the brightness in the area surrounding the light sources is deteriorated. Accordingly, in the direct-type backlight unit, the illumination unevenness is more likely to occur in the second display area that is closer to the area surrounding the light sources than the first display area. The display device according to the present invention includes the first correction circuit that only corrects the image data for the second display area. Thus, even if the unevenness occurs in the second display area, the unevenness can be advantageously reduced.

Advantageous Effect of the Invention

According to the present invention, the unevenness can be reduced and the deterioration of brightness and gradation characteristics can be suppressed.

BEST MODE FOR CARRYING OUT THE INVENTION

<First Embodiment>

The first embodiment of the present invention will be described with reference to the drawings. The following embodiment will be described using a liquid crystal display device equipped with a liquid crystal panel as a display device. However, the technology according to the present invention is not only applicable to such a display device, but also applicable to an active matrix type display device such as PDP (Plasma Display Panel) display device and an organic EL (electro luminescence) display device, for example.

1. Construction of the Liquid Crystal Display Device 10

The construction of the liquid crystal display device 10 will be explained with reference to FIG. 1.

Figure 1:
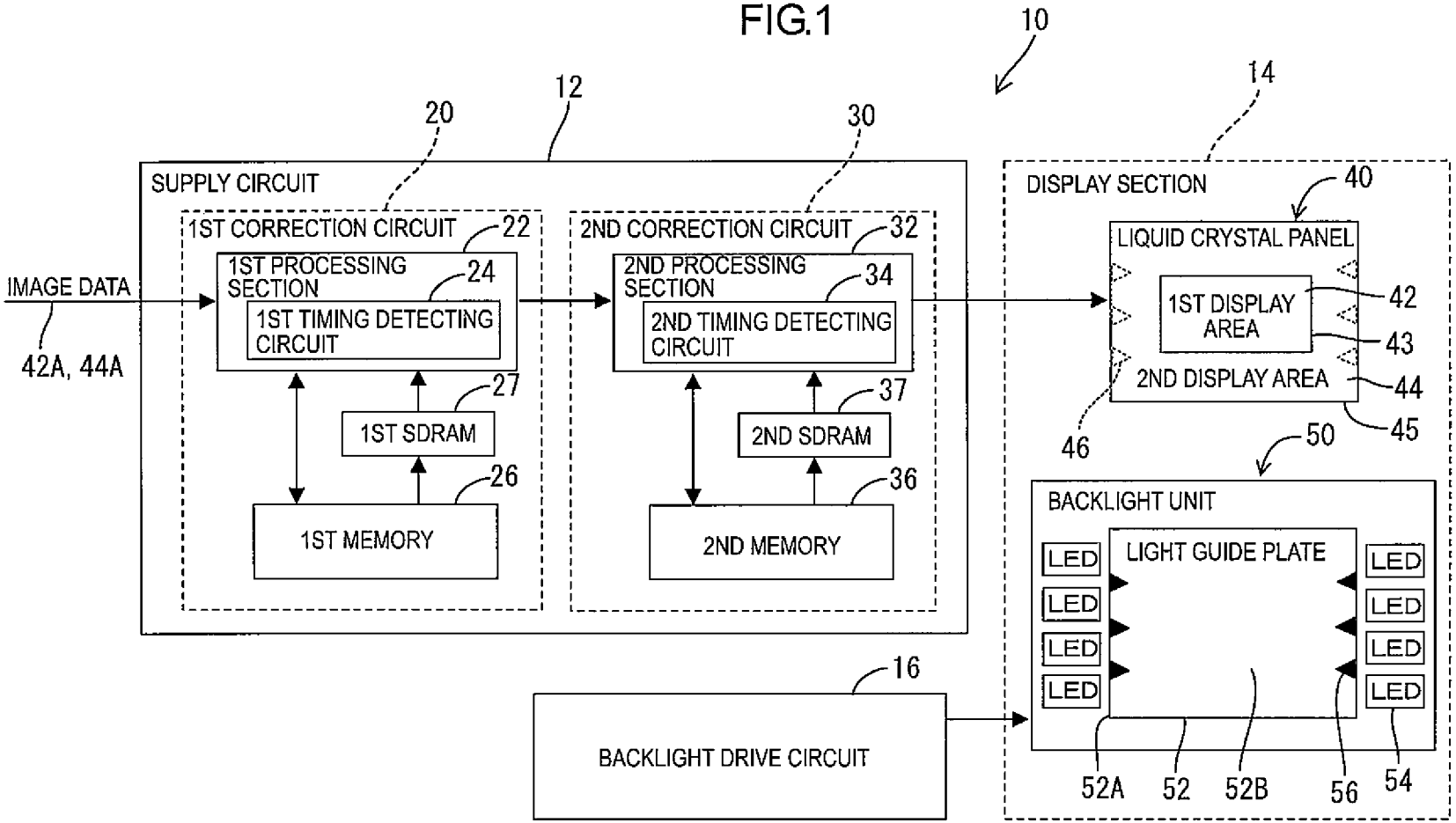
FIG. 1 is a view illustrating a configuration of a liquid crystal display device 10.

As illustrated in FIG. 1, the liquid crystal device 10 includes a supply circuit 12, a display section 14, and a backlight drive circuit 16. The display section 14 includes a liquid crystal panel 40 and a backlight unit 50.

The liquid crystal panel 40 includes a display area on which an image is displayed. The display area of the liquid crystal panel 40 is divided into a first display area 42 and a second display area 44. The first display area 42 includes a middle portion of the display area and the second display area 44 includes an outer portion around the first display area 42. The term "divided" herein is used not only for the display area of the liquid crystal panel 40 that is physically separated, but also the display area that is formally divided into sections by the image data. The image data may be supplied to the liquid crystal panel 40 after being divided. The second display area 44 extends from a boundary 43 between the first display area 42 and the second display area 44 to an outer periphery 45 of the liquid crystal panel 40. The first display area 42 and the outer peripheries 45 are separated by the second display area 44. The second display area 44 includes all of the outer peripheries 45. In other words, in the present embodiment, the second display area 44 extends along all of the four outer peripheries 45 of the liquid crystal panel 40 that is formed in a rectangular shape.

Figure 8:
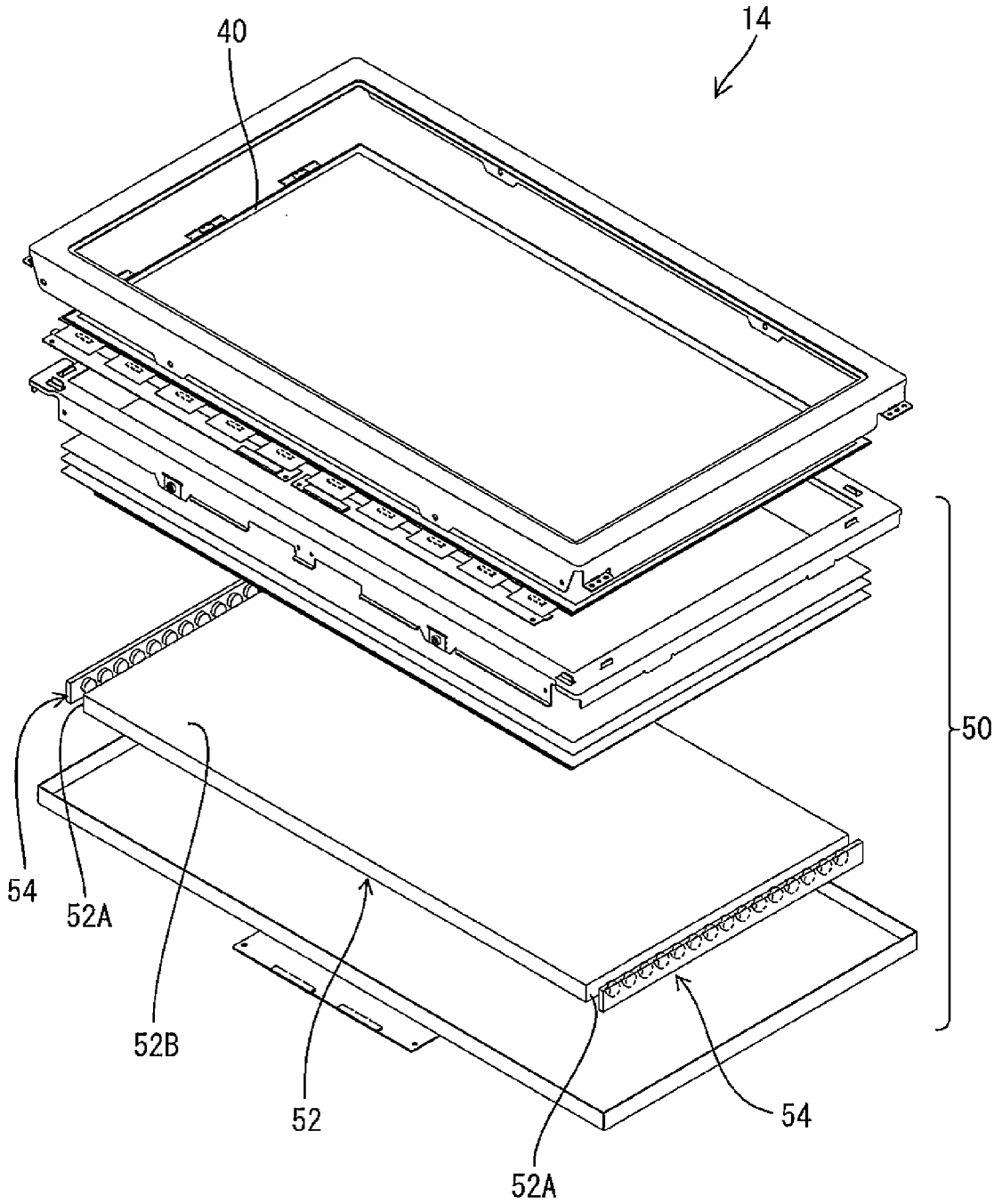
FIG. 8 is an exploded view of a display section 14 including an edge-light type backlight unit 50.

The backlight unit 50 is arranged behind the liquid crystal panel 40. FIG. 8 illustrates an exploded view of the display section 14. As illustrated in FIG. 8, the backlight unit 50 includes LEDs 54 (Light Emitting Diode) as light sources and a light guide plate 52. The LEDs 54 are arranged to face a side surface of the light guide plate 52. The light guide plate 52 is arranged such that a main surface thereof faces the liquid crystal panel 40. In the guide plate 52, the light emitted from the LEDs 54 and entered through the side surface thereof is guided to the main surface that faces the liquid crystal panel 40. The side surface of the light guide plate 52 serves as a light entrance surface 52A through which the light emitted from the LEDs 54 enters the light guide plate 52. The main surface of the light guide plate 52 serves as a light exit surface 52B through which the light traveling in the light guide plate 52 exits to illuminate the liquid crystal panel 40. As described above, the backlight unit 50 is an edge-light type (side-light type) backlight unit in which the LEDs 54 are arranged at each end portion of the long side of the backlight unit 50 and the light guide plate 52 is arranged therebetween.

The backlight drive circuit 16 is connected to the LEDs 54 included in the backlight unit 50. The backlight drive circuit 16 supplies current to each of the LEDs 54. The amount of current to be supplied to the LEDs 54 is controlled, and thus the amount of light to be entered into the light guide plate 52 from the LEDs 54 is adjusted.

The supply circuit 12 supplies image data that is supplied from an external device (not illustrated) to each of the display areas 42, 44 of the liquid crystal panel 40. The image data includes first image data 42A for the first display area 42 and second image data 44A for the second display area 44. The supply circuit 12 supplies the first image data 42A to the first display area 42 to display a predetermined image in the first display area 42. Further, the supply circuit 12 supplies the second image data 44A to the second display area 44 to display a predetermined image in the second display area 44.

The supply circuit 12 includes a first correction circuit 20 and a second correction circuit 30.

The first correction circuit 20 performs a first correction on the second image data 44A. The first correction circuit 20 includes a first processing section 22, a first memory 26, and a first SDRAM 27. The first processing section 22 includes a first timing detecting circuit 24 that measures time elapsed from the start of the image data supply. The input timing of the first image data 42A and the second image data 44A is determined in advance based on an arrangement of display elements provided in the display area of the liquid crystal panel 40. In the first correction circuit 20, the image data is divided into the first image data 42A and the second image data 44A based on the elapsed time measured by the first timing detecting circuit 24. Then, the first correction is performed only on the second image data 44A.

The first memory 26 stores first correction data to be used in the first correction. The first correction is performed only on the second image data 44A. Accordingly, the capacity of the first memory 26 can be reduced to a size corresponding to the second image data 44A.

In the first correction circuit 20, when the first correction starts, the first timing detecting circuit 24 measures time elapsed from the start of the image data supply. Further, the first processing section 22 extracts the second image data 44A from the image data supplied by the external device. Furthermore, from the first memory 26, the first SDRAM 17 retrieves the first correction data that correspond to the second image data 44A extracted by the first processing section 22. The second image data 44A is corrected by transferring the first correction data between the first processing section 22 and the first SDRAM 27. The first memory 26 is a non-volatile memory so as not to lose the first correction data even when the power of the supply circuit 12 is turned off. However, the non-volatile memory generally has a lower data transfer rate than a volatile memory such as SDRAM. The first correction circuit 20 employs the first SDRAM 27. A processing rate of the first correction is improved by transferring the correction data between the first processing section 22 and the first SDRAM 27.

The second correction circuit 30 performs the second correction on the first image data 42A and the second image data 44A. The second correction circuit 30 includes a second processing section 32, a second memory 36, and a second SDRAM 37. The second processing section 32 includes a second timing detecting circuit 34 that measures time elapsed from the start of the image data supply. The second memory 36 stores second correction data to be used in the second correction.

In the second correction circuit 30, when the second correction starts, the second timing detecting circuit 34 measures time elapsed from the start of the image data supply. Further, the second processing section 32 receives the image data subjected to the first correction from the first correction circuit 20. Furthermore, from the second memory 36, the second SDRAM 37 retrieves the second correction data corresponding to the image data received by the second processing section 32. The first image data 42A and the second image data 44A are corrected by transferring the second correction data between the second processing section 32 and the second SDRAM 37. The processing rate of the second correction is also improved by the use of the second SDRAM 37.

2. Determination Processing of Correction Data and First Display Area

In the liquid crystal display device 10, a determination processing for determining the correction data and the first display area 42 is performed before use. Generally, the correction data and the first display area 42 should be determined for every liquid crystal display device 10 in view of factors specific to the liquid crystal panel 40 and the backlight unit 50 of each liquid crystal display device 10. However, if the liquid crystal panels 40 and the backlight units 50 that are manufactured on the same assembly line for mass production, the cause of the unevenness may be the same. In such a case, the determination processing is performed in advance to determine the correction data and the first display area 42 for a plurality of liquid crystal devices 10. This facilitates the determination processing in the liquid crystal display devices 10.

Figure 2:
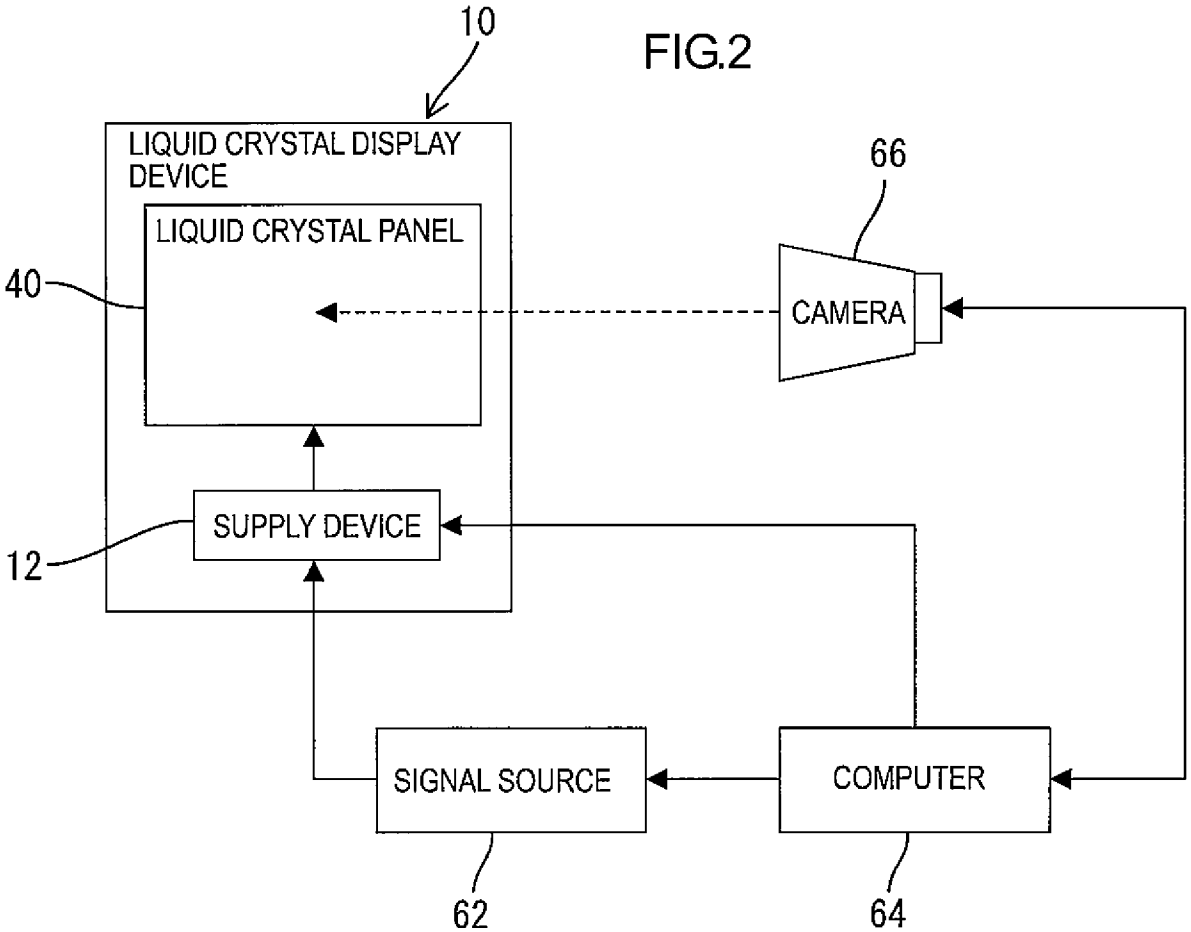
FIG. 2 is a view illustrating how correction data and a first display area are determined.

The above determination processing is performed after the liquid crystal display device 10 is connected as illustrated in FIG. 2. The liquid crystal display device 10 is connected to a signal source 62. The image data supplied by the signal source 62 is displayed on the display area of the liquid crystal panel 40. A camera 66 is arranged on the front of the liquid crystal panel 40. The liquid crystal panel 40 is captured by the camera 66. The signal source 62 and the camera 66 are connected to a computer 64 to perform a specific operation by instructions from the computer 64. The computer 64 is connected to the supply circuit 12 of the liquid crystal display device 10. The information relating to the correction data and the first display area 42 determined by the determination processing is stored in the first memory 26 and the second memory 36.

Figure 3:
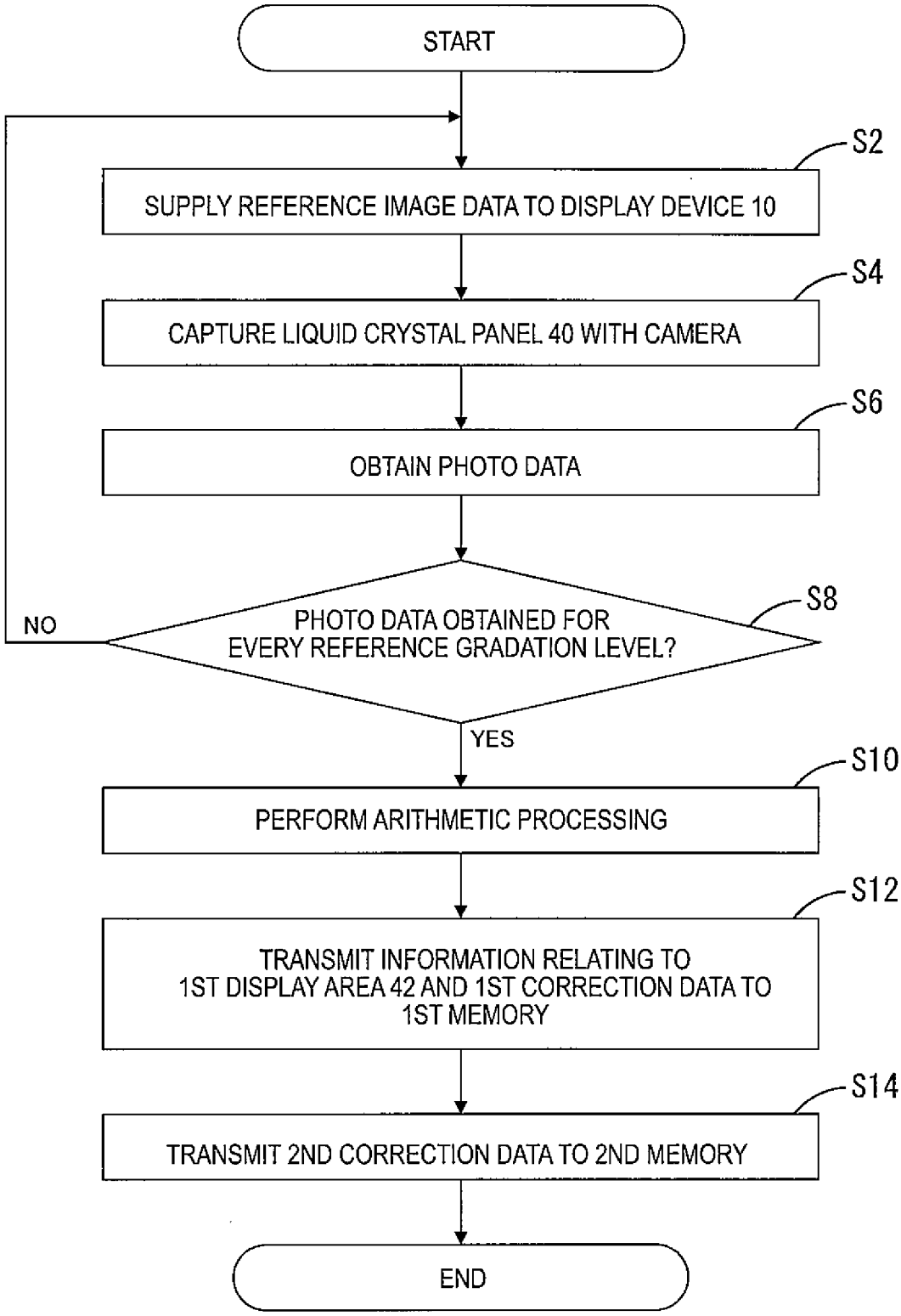
FIG. 3 is a flow diagram of a determination processing.

The determination processing will be explained with reference to FIG. 3.

At the start of the determination processing, the computer 64 supplies the image data from the signal source 62 to the liquid crystal display device 10 (step S2). The image data (hereinafter may be referred to as a reference image data) have a reference gradation level and is in solid pattern. In the computer 64, reference gradation levels are selected from gradation levels displayable on the liquid crystal panel 40. The reference image data for each reference gradation level is stored in the signal source 62 in advance. In the determination processing, the correction data and the first display area 42 are not determined, and thus the first correction and the second correction are not performed on the reference image data.

Next, the computer 64 controls the camera 66 to capture the liquid crystal panel 40 (step S4), and then obtains photographic data from the camera 66 (step S6). The computer 64 determines whether the photographic data have been obtained for each reference gradation level (step S8). If the photographic data have not been obtained for each reference gradation level (NO in S8), the step S2 and the step S6 are repeated. If the photographic data have been obtained for each reference gradation level (YES in S8), an arithmetic processing is performed (step S10).

Figure 4:
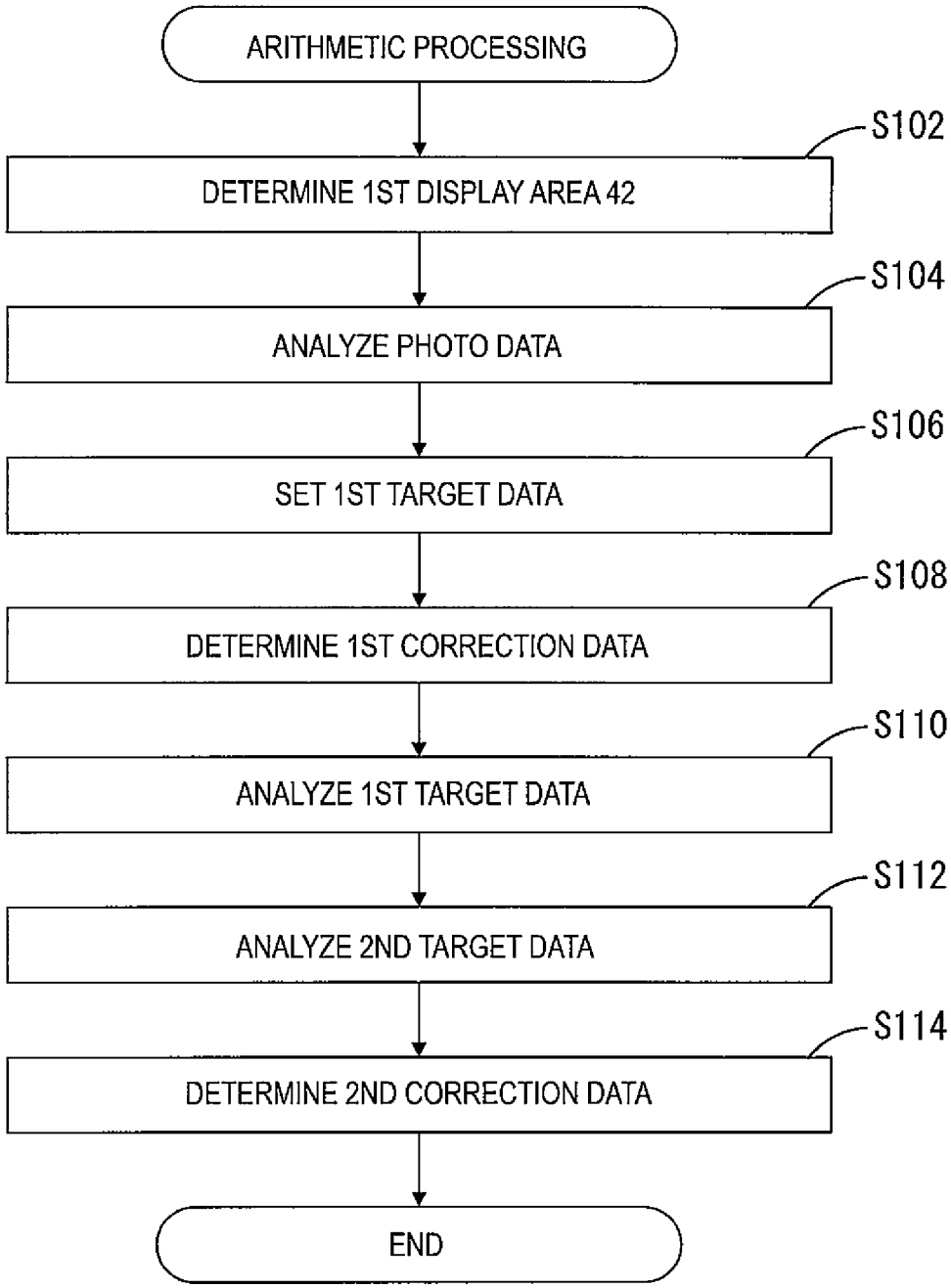
FIG. 4 is a flow diagram of an arithmetic processing.

As illustrated in FIG. 4, in the arithmetic processing, the computer 64 extracts brightness value from the photographic data, and a first display area 42 is determined by the extracted brightness value (step S102). More specifically described, the computer 64 compares the extracted brightness value with a target brightness value K to detect a low brightness area that has a brightness value lower than the target brightness value K. The target brightness value K is set for each reference gradation level.

Figure 5:
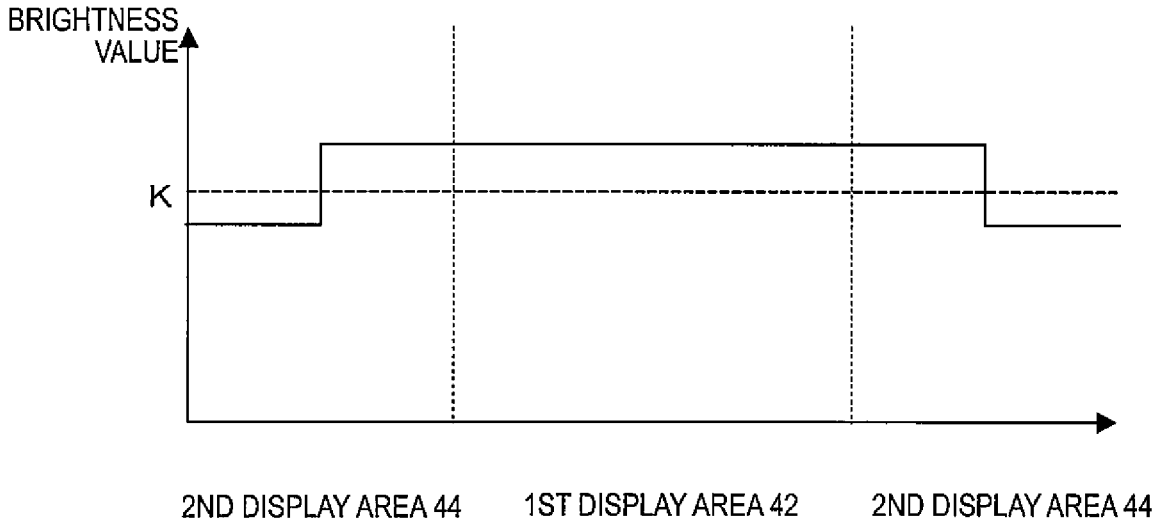
FIG. 5 is a diagram illustrating a brightness value distribution before the correction processing in a cross section taken along a line V-V.

As illustrated in FIG. 1, in the edge-light type backlight unit 50 of the present embodiment, the LEDs 54 are arranged so as to face the side surfaces of the light guide plate 52. Thus, the illumination unevenness 56 may occur between the adjacent LEDs 54, 54. This may cause the unevenness 46 in the liquid crystal panel 40. FIG. 5 illustrates a brightness value distribution before the first correction and the second correction in a cross-section taken along a line V-V. An area including the unevenness 46 has a brightness value lower than that of the other areas and lower than the target brightness value K (a broken line). The computer 64 detects the area including the unevenness 46 as the low brightness area.

The computer 64 detects the low brightness area for each reference gradation level. Then, the area satisfying the following two conditions is determined as the first display area 42:

(1) the first display area 42 is broader than a characteristics determination area; and (2) the first display area 42 does not include the low brightness area while the condition (1) is satisfied.

The "characteristics determination area" is an area for determining the characteristics of the liquid crystal display device 10. Generally, the characteristics determination area is set at a middle portion of the display area of the liquid crystal panel 40. A range of the characteristic determination area is determined according to a measurement range of a measuring device used in a characteristics measurement.

Next, the computer 64 analyzes the characteristics of the photographic data (step S104) and sets a first target data (step S106). The first target data is the same as the reference image data in the first display area 42 and is different from the reference image data in the second display area 44. In the liquid crystal panel 40, the brightness value in the middle portion of the display area may be improved by the light applied from the outer periphery of the display area in some cases. In such a case, the brightness value in the second display area 44 may be lowered than the brightness value in the first display area 42. The computer 64 sets the first target value in the second display area 44 with reference to the following characteristics of the liquid crystal panel 40, for example:

(1) the extracted brightness value distribution;

(2) the degree of reduction in brightness in the low brightness area; and (3) the range of the first display area 42.

Next, the computer 64 determines the first correction data (step S108). Specifically, correction data is calculated such that the reference image data in the second display are 44 is corrected to the first target data in the second display area 44. This correction data is determined as the first correction data. In the present embodiment, even when the edge-light type backlight unit 50 is used, the reference image data is corrected to the first target data by the first correction data. As a result, the illumination unevenness is less likely to be caused by the backlight unit 50.

In the arithmetic processing, the first target data is set for each of the reference gradation levels selected by the computer 64, and the first correction data is also determined. Generally, correction required for the image data is different according to gradation level. The first correction data is set for each of the selected reference gradation levels, and thus the correction suitable for each gradation level can be performed. In the gradation level between the reference gradation levels, correction suitable for the gradation level can be performed by linearly interpolating two reference gradation levels close to the gradation level.

Next, the computer 64 analyzes the first target data (step S110) and sets the second target data (step S112). Even if the brightness value in the first display area 42 is higher than the target brightness value K and no local reduction in the brightness value can be observed, the brightness value may have long-period unevenness. In the long-period unevenness, the brightness value may rise and fall without falling below the target brightness value, for example. The computer 64 analyzes the first target data and sets the second target data if the long-period unevenness is detected. The second target data in the first display area 42 and the second target data in the second display area 44 are not necessarily the same. The second target data may be separately set for the first display area 42 and the second display area 44.

Next, the computer 64 determines the second correction data (step S114). Specifically, correction data is calculated such that the first target data is corrected to the second target data. The correction data is determined as the second correction data. This is the end of the arithmetic processing of the computer 64.

In the arithmetic processing, the second target data is set for each of the reference gradation levels selected by the computer 64, and the second correction data is also determined. The second correction data is set for each of the selected reference gradation levels, and thus the correction suitable for each gradation level can be performed.

Next, the computer 64 transmits the information relating to the first display area 42 and the first correction data to the first memory 26 (step S12). The first memory 26 stores the transmitted information. Further, the computer 64 transmits the second correction data to the second memory 36 (step S14). The second memory 36 stores the second correction data. This is the end of the determination processing of the computer 64.

3. Operation of the Supply Circuit 12

When the external device starts supplying the image data during the use of the liquid crystal display device 10, the timing detecting circuits 24, 34 in the supply circuit 12 measures the time elapsed from the start of the image data supply. Then, the first correction circuit 20 performs the first correction on the second image data 44*a* included in the supplied image data. Then, the second correction circuit 30 performs the second correction on the image data corrected by the first correction circuit 20. The supply circuit 12 supplies the image data corrected by the first correction circuit 20 and the second correction circuit 30 to the liquid crystal panel 40, and thus an image is displayed on the liquid crystal panel 40. As a result, the liquid crystal display device 10 operates.

More specifically described, the first correction circuit 20 in the supply circuit 12 performs the first correction on the supplied image data. In the first correction, the first correction circuit 20 performs the first correction on the second image data 44A of the supplied image data and does not perform the correction on the first image data 42A. The correction on the second image data 44A can reduce the unevenness in the second display area 44. An example of the unevenness is the illumination unevenness caused by the backlight unit 50. Further, the deterioration of brightness and gradation characteristics of the first display area 42 can be suppressed by not correcting the first image data 42A. The first display area 42 is often used as the characteristics determination area. The characteristics of the liquid crystal panel 40 can be maintained at a high level by suppressing deterioration of brightness and gradation characteristics of the first display area 42.

In the supply circuit 12, the second correction is performed on the supplied image data by the second correction circuit 30 after the first correction is performed by the first correction circuit. The difference in brightness value in the illumination unevenness that may occur in the second display area 44 is so large as to extend across the target brightness value K. Thus, the unevenness in the second display area 44 should be corrected more than the long-period unevenness that may occur in the first display area 42. By performing the second correction on the area including the first display area 42 and the second display area 44 after the first correction is performed to correct the unevenness occurred in the second display area 44, the correction required in the second correction can be reduced. This can suppress the deterioration of brightness and gradation characteristics of the first display area 42.

4. Characteristics of the First Correction Data

Figure 6:
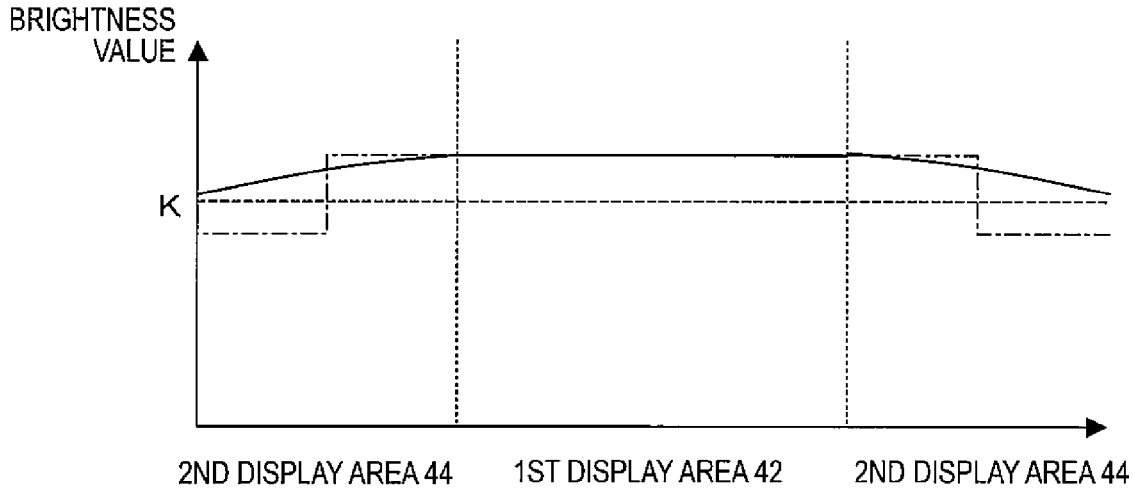
FIG. 6 is a diagram illustrating a brightness value distribution after the correction processing in a cross section taken along a line V-V.

FIG. 6 illustrates a brightness value distribution of the liquid crystal panel 40 in a cross-section taken along a line V-V. The image data subjected to the first correction has been supplied to the liquid crystal panel 40. This image data is the same as the image data supplied to the liquid crystal panel 40 from the supply circuit 12 without the second correction (the second correction is not required). In FIG. 6, for comparison with FIG. 5, the brightness value distribution that is obtained when the reference image data supplied in FIG. 5 is supplied to the supply circuit 12 is indicated. The target brightness value K is indicated in a broken line, and the brightness value distribution of the liquid crystal panel 40 in FIG. 5 is indicated in a one-dotted chain line.

The characteristics of the first correction data will be explained with reference to FIG. 6.

(1) The first correction data is determined such that the brightness value of the reference image data subjected to the first correction is consecutive at the boundary 43 between the first display area 42 and the second display area 44. Accordingly, even if the display area is physically divided into the first display area 42 and the second display area 44 in the correction of the image data for the liquid crystal panel 40, the boundary 43 between the first display area 42 and the second display area 44 is not visible to the user of the liquid crystal display device 10.

(2) The first correction data is determined such that the brightness value of the reference image data subjected to the first correction become smaller toward the outer periphery of the liquid crystal panel 40 from the middle thereof in the second display area 44. Accordingly, as illustrated in a one-dotted chain line in FIG. 5, even when the brightness value of the outer periphery of the display area is smaller than that of the middle portion of the display area in the display panel 40 in which the image before the correction is displayed, the reduction in brightness is less likely to be noticed by the user of the liquid crystal display device 10.

<Second Embodiment>

Figure 7:
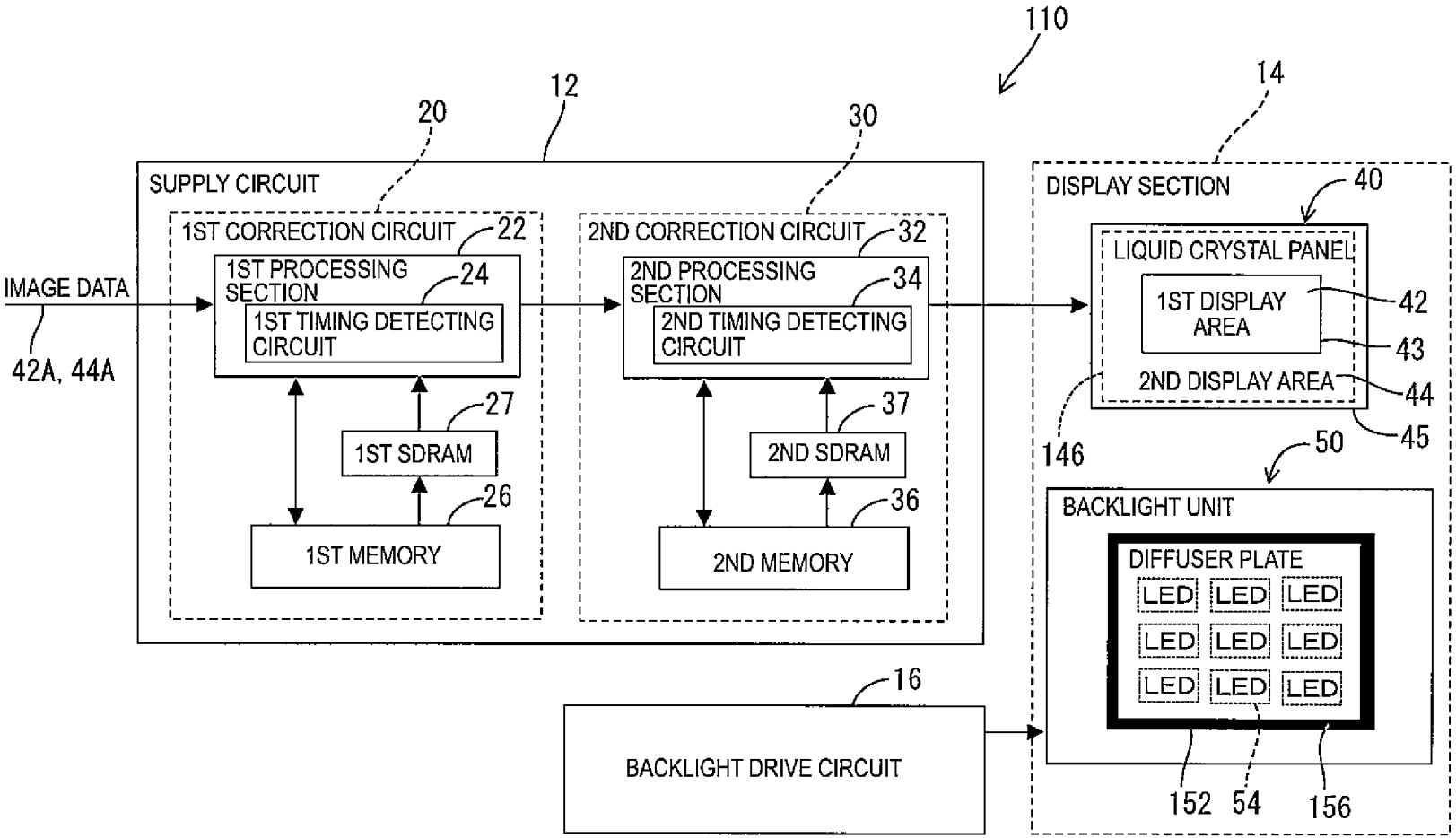
FIG. 7 is a view illustrating a configuration of a liquid crystal display device 110.
Figure 9:
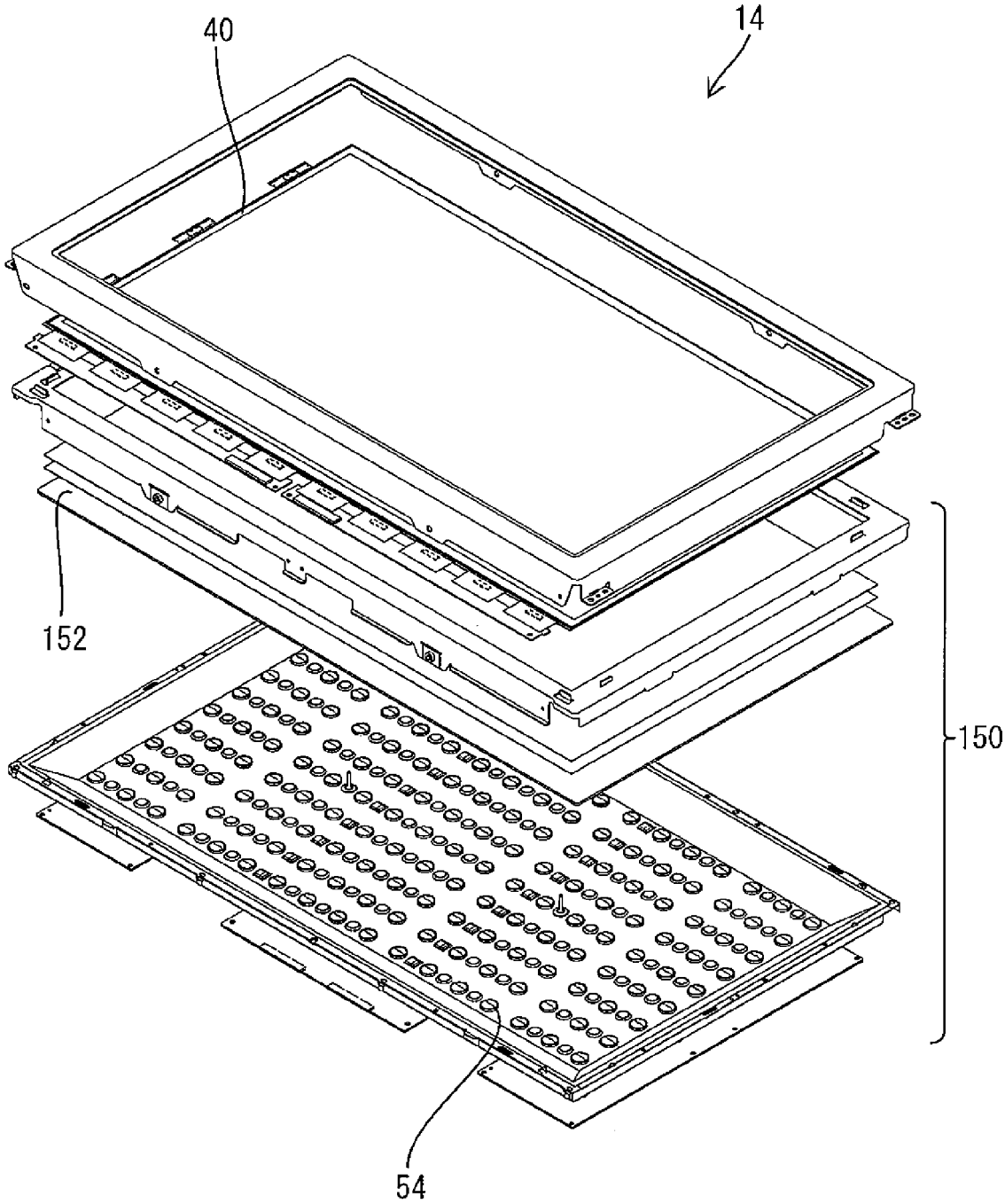
FIG. 9 is an exploded view of a display section 14 including a direct-type backlight unit 150.

A liquid crystal display device 110 according to the second embodiment of the present invention is illustrated in FIG. 7. The liquid crystal display device 110 includes a backlight unit 150 that has a configuration different from that of the liquid crystal display device 10 of the first embodiment. FIG. 9 illustrates the display section of the liquid crystal display device 110 in an exploded view. As illustrated in FIG. 9, the backlight unit 150 includes the LEDs 54 and a diffuser plate 152. The LEDs 54 are arranged so as to face the rear surface of the diffuser plate 152. The diffuser plate 152 is arranged such that the main surface thereof faces the liquid crystal panel 40. The light emitted from the LEDs 54 enters through the rear surface of the diffuser plate 152. The light is diffused by and penetrated through the diffuser plate 52. The diffused light is applied to the liquid crystal panel 40 from the main surface facing the liquid crystal panel 40. The backlight unit 150 is a direct-type backlight unit in which the LEDs 54 are arranged on the rear surface side and the diffuser plate 152 is arranged on the front side in the thickness direction of the backlight unit 150.

As illustrated in FIG. 7, in the direct-type backlight unit 150 of the present embodiment, the illumination unevenness 156 may occur in an outer peripheral area surrounding the LEDs 54 arranged on the rear side of the diffuser plate 152. This may cause the unevenness 146 on the liquid crystal panel 40.

As in the present embodiment, even when the direct-type backlight unit 150 is used, the first display area 42 and the first correction data can be determined using the backlight unit 150, and the first correction is performed with the determined first correction data. Accordingly, the illumination unevenness is less likely to be caused by the backlight unit 150.

<Other Embodiments>

The present invention is not limited to the above embodiments described in the above description and the drawings. The following embodiments are also included in the technical scope of the present invention, for example.

(1) In the above embodiments, the correction data and the first display area 42 are determined based on the brightness value extracted from the photographic data of the liquid crystal panel 40. However, the present invention is not limited to this. A chromaticity value may be extracted from the photographic data and used to determine the correction data and the first display area 42. Alternatively, both of the brightness value and the chromaticity value may be used.

(2) In the above embodiments, the first correction circuit 20 and the second correction circuit 30 are described as separate circuits. However, the first correction circuit 20 and the second correction circuit 30 may be one circuit that performs two corrections, like a timing controller (T-CON). Further, the first timing detecting circuit 24 and the second detecting circuit 34 may be one timing detecting circuit. The same may be applied to the first memory 26 and the second memory 36, and the first SDRAM 27 and the Second SDRAM 37.

(3) In the above embodiments, the first correction and the second correction are independently effective and two of them are not necessarily performed. For example, when the illumination unevenness occurs without the long-period unevenness, only the first correction should be performed. When the long-period unevenness occurs without the illumination unevenness, only the second correction should be performed.

(4) In the above embodiments, the LED is used as a light source. Alight source other than the LED may be used.

EXPLANATION OF SYMBOLS

10: display device, 12: supply circuit, 14: display section, 16: backlight drive circuit, 20: first correction circuit, 30: second correction circuit, 40: liquid crystal panel, 42: first display area, 44: second display area, 45: outer periphery, 50: backlight unit, 52: light guide plate, 52A: light entrance surface, 52B: light exiting surface, 54: LED, 56: illumination unevenness, 62: signal source, 64: computer, 66: camera, 152: diffuser plate

The invention claimed is:

1. A method of driving a display panel having a display area including a first display area and a second display area, the first display area including a middle portion of the display panel, the second display area including an outer portion of the display panel around the first display area, the method comprising:

supplying image data to each of the first display area and the second display area to display an image therein; and performing a first correction to correct only the image data for the second display area while said supplying the image data is being performed;

wherein the first correction includes correcting the image data for the second display area based on first correction data determined for each of reference gradation levels, the gradation levels being selected from displayable gradation levels; and wherein if a uncorrected brightness value of the image data in the first display area and a uncorrected brightness value of the image data in the second display area are consecutively present at a boundary between the first display area and the second display area, the first correction data is determined such that the uncorrected brightness value of the image data in the first display area and a corrected brightness value of the image data in the second display area are consecutively present, the corrected brightness value being defined by correcting the uncorrected brightness value in the second display area based on the first correction data.

2. The method according to claim 1, wherein the second display area includes at least one outer periphery of the display area of the display panel.

3. The method according to claim 1, wherein the second display area at least includes two opposing outer peripheries of the display area of the display panel.

4. The method according to claim 1, further comprising performing a second correction to correct the image data for the display area including the first display area and the second display area, wherein the second correction is performed after the first correction.

5. The method according to claim 1, wherein the display panel is a liquid crystal panel using liquid crystals.

6. A driving circuit for a display panel having a display area including a first display area and a second display area, the first display area including a middle portion of the display panel, the second display area including an outer portion of the display panel around the first display area, the driving circuit comprising a supply circuit configured to supply image data to each of the first display area and the second display area to display an image therein, wherein the supply circuit includes a first correction circuit configured to correct only the image data for the second display image area by correcting the image data for the second display area based on first correction data determined for each of reference gradation levels, the gradation levels being selected from displayable gradation levels; and wherein if a uncorrected brightness value of the image data in the first display area and a uncorrected brightness value of the image data in the second display area are consecutively present at a boundary between the first display area and the second display area, the first correction data is determined such that the uncorrected brightness value of the image data in the first display area and a corrected brightness value of the image data in the second display area are consecutively present, the corrected brightness value being defined by correcting the uncorrected brightness value in the second display area based on the first correction data.

7. A display device, comprising:

a display panel having a display area including a first display area and a second display area, the first display area including a middle portion of the display panel, the second display area including an outer portion of the display panel around the first display area; and a supply circuit configured to supply image data to each of the first display area and the second display area to display an image therein, wherein the supply circuit includes a first correction circuit configured to correct only the image data for the second display area by correcting the image data for the second display area based on first correction data determined for each of reference gradation levels, the gradation levels being selected from displayable gradation levels; and wherein if a uncorrected brightness value of the image data in the second display area become smaller toward an outer periphery of the display panel from a middle thereof, the first correction data is determined such that a corrected brightness value of the image data in the second display area becomes smaller toward the outer periphery of the display panel from the middle thereof, the corrected brightness value being defined by correcting the uncorrected brightness value in the second display area based on the first correction data.

8. The display device according to claim 7, further comprising a backlight unit including a light source and a light guide plate, wherein:

the light guide plate has a light entrance surface facing the light source and a light exit surface facing the display panel, the light guide plate being configured to guide light emitted from the light source and passed through the light entrance surface to the light exit surface; and the light entrance surface is a side surface of the light guide plate and the light exit surface is a main surface of the light guide plate.

9. The display device according to claim 7, further comprising a backlight unit, wherein the backlight unit includes a light source facing the display panel and a diffuser plate arranged between the light source and the display panel.

10. A method of driving a display panel having a display area including a first display area and a second display area, the first display area including a middle portion of the display panel, the second display area including an outer portion of the display panel around the first display area, the method comprising:

supplying image data to each of the first display area and the second display area to display an image therein; and performing a first correction to correct only the image data for the second display area while said supplying the image data is being performed;

wherein the first correction includes correcting the image data for the second display area based on first correction data determined for each of reference gradation levels, the gradation levels being selected from displayable gradation levels; and wherein if a uncorrected brightness value of the image data in the second display area become smaller toward an outer periphery of the display panel from a middle thereof, the first correction data is determined such that a corrected brightness value of the image data in the second display area becomes smaller toward the outer periphery of the display panel from the middle thereof, the corrected brightness value being defined by correcting the uncorrected brightness value in the second display area based on the first correction data.

11. The method according to claim 10, wherein the second display area includes at least one outer periphery of the display area of the display panel.

12. The method according to claim 10, wherein the second display area at least includes two opposing outer peripheries of the display area of the display panel.

13. The method according to claim 10, further comprising performing a second correction to correct the image data for the display area including the first display area and the second display area, wherein the second correction is performed after the first correction.

14. The method according to claim 10, wherein the display panel is a liquid crystal panel using liquid crystals.

* * * * *